United States Patent [19]

Stokoe et al.

[11] Patent Number: 4,616,410

[45] Date of Patent: Oct. 14, 1986

[54] HIGH SPEED LEAD SOCKET ASSEMBLY MACHINE

[75] Inventors: Philip T. Stokoe, North Attleboro, Mass.; Glenn N. Cleaver, Lincoln, R.I.; Dennis R. Boulais, Danielson, Conn.

[73] Assignee: Augat Inc., Mansfield, Mass.

[21] Appl. No.: 735,393

[22] Filed: May 17, 1985

[51] Int. Cl.[4] ..... H01R 43/00

[52] U.S. Cl. ..... 29/743; 29/747; 29/759; 29/760; 29/881

[58] Field of Search ..... 29/743, 760, 747, 876, 29/881, 882, 759; 414/750, 751

[56] References Cited

U.S. PATENT DOCUMENTS

| | | | |
|---|---|---|---|
| 3,520,055 | 7/1970 | Jannett | 29/760 |
| 3,704,504 | 12/1972 | Koegler | 29/743 |
| 4,089,105 | 5/1978 | Yeo et al. | 29/743 |

*Primary Examiner*—Carl E. Hall

*Attorney, Agent, or Firm*—Weingarten, Schurgin, Gagnebin & Hayes

[57] ABSTRACT

A machine for the assembly of socket contacts and similar items having a sleeve portion and a contact portion within the sleeve. The machine includes a rotatable drum having an array of recesses about the circumferential wall, each of the recesses including a lower section for retaining a sleeve portion, and an upper section for retaining the contact portion. The parts are retained in the recesses by vacuum controlled by a manifold assembly within the drum. A cam assembly above the drum is operative during drum rotation to urge the contacts into the respective sleeves, and the seating force can be monitored during insertion of the contacts into the sleeves for rejection of components assembled with seating forces which are outside of intended specification.

12 Claims, 6 Drawing Figures

HIGH SPEED LEAD SOCKET ASSEMBLY MACHINE

FIELD OF THE INVENTION

This invention relates to component assembly machines, and more particularly to a machine for the automatic assembly of electronic socket contacts.

BACKGROUND OF THE INVENTION

There is a type of electronic socket contact which is widely used in electronic circuit boards and in electronic component sockets, in which a contact finger assembly is inserted and retained within a sleeve to form the completed socket contact. A plurality of such socket contacts can be retained within a plastic or other electrically insulative body to provide a component socket into which the leads of an electronic component are inserted. The socket contacts can also be retained within openings in a circuit board for acceptance of the leads of electronic components. A preferred socket contact is shown in U.S. Pat. No. 4,186,990 of the assignee of this invention.

An assembly machine which has been employed for assembly for the two parts of this type of socket generally includes a rotatable table containing openings therethrough around a circumferential track of the table. A socket body is inserted and retained in respective openings, and the contact portion is inserted into each recess atop a body portion which has previously been inserted into the recess. An anvil or other driving tool forces the contact portion into the body portion, and the assembled component is ejected from the bottom of the recess. The contact portion cannot always be accurately and repeatably aligned with the body portion during assembly by conventional machinery, and misalignment can occur in an assembled component with resulting decrease in the yield of acceptable components. In addition, the driving force of the tool employed for inserting the contact portion into the body portion is not controllable to a high degree of precision, resulting in contact or component damage.

SUMMARY OF THE INVENTION

In accordance with this invention, an improved assembly machine is provided for the high-speed precision assembly of socket contacts. The machine includes a rotatable cylindrical drum having a plurality of recesses disposed about the circumferential wall in equispaced position. Each of the recesses includes a lower section adapted to retain the sleeve portion of a socket contact, and an upper section adapted to retain the contact assembly portion of the socket contact. The parts of the contact to be assembled are retained in the recesses by vacuum, controlled by a manifold assembly within the circumferential drum. Parts are supplied to the recesses from respective supply bins, and are conveyed to the recesses typically by a vibratory conveyor. A cam assembly is provided above the rotatable drum and is operative during rotation to urge the contact assembly into the sleeve. After mating of the two parts of the contact, the assembled device is ejected from the rotatable drum into a collection bin. The drum rotates continuously during operation, and parts to be assembled are supplied to each vacant recess as it passes the respective supply points.

The cam assembly includes a load cell for monitoring the actual force applied during seating of the contact assembly portion into the sleeve portion. If a seating force above a predetermined maximum level is measured, such as can occur in the assembly of parts having dimensions for too tight a fit, the part thus assembled with the excessive force can be identified and rejected, since such excessive force can likely have caused damage to the component. If a seating force below a predetermined minimum level is measured, signifying too loose a fit, that part can be identified and rejected.

The novel assembly machine is capable of a high throughput of components being assembled and is adapted to be fed from multiple supply hoppers.

DETAILED DESCRIPTION OF THE INVENTION

Figure 1:
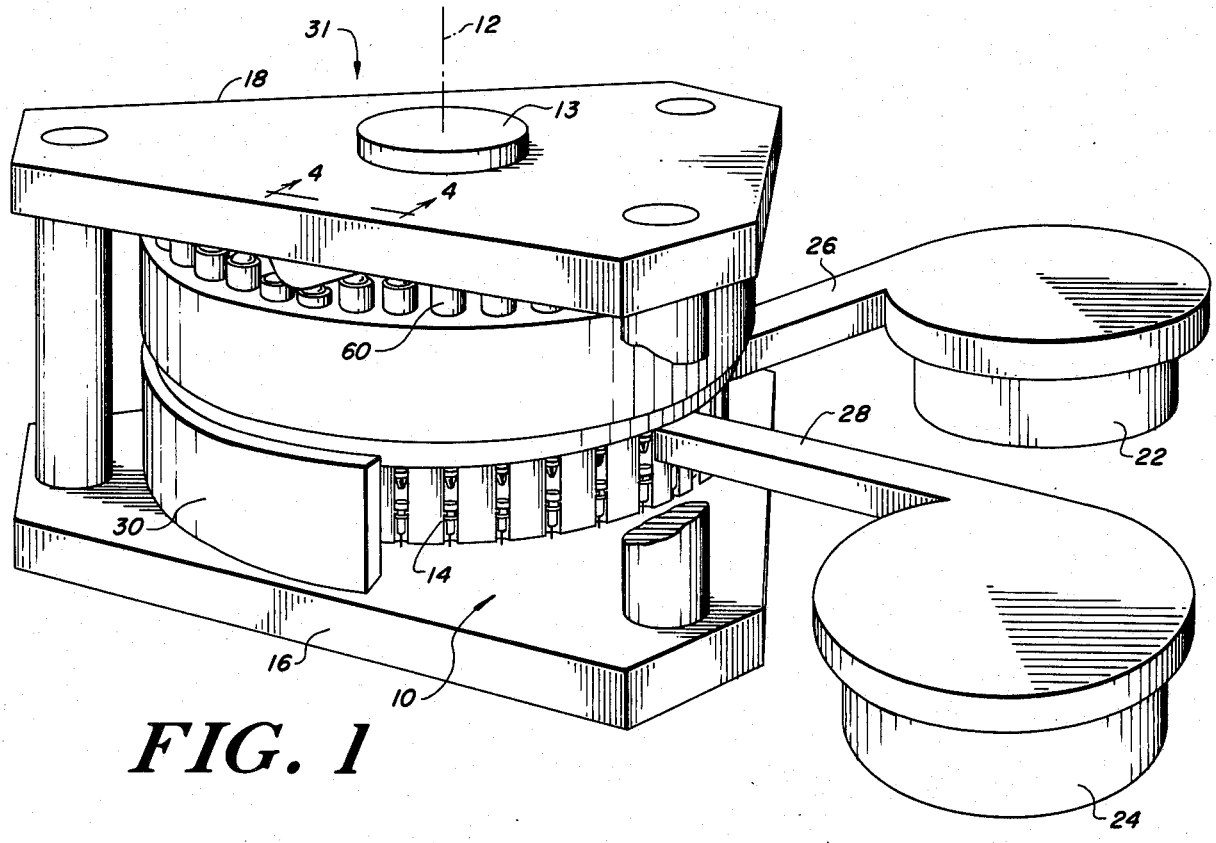

The assembly machine is shown in overall form in FIG. 1 and comprises a drum 10 rotatable about an axis 12 on a shaft 13, and having a plurality of recesses 14 equally spaced about the periphery of the drum, each of the recesses being generally semi-cylindrical and operative to retain by vacuum the sleeve and contact portions of an electrical socket being assembled. The drum 10 is supported for rotation on a support structure which includes lower plate 16, upper plate 18 and posts 20 which retain the upper and lower plates in intended spaced position. The contact and sleeve portions of the electrical sockets being assembled are respectively contained in feed hoppers 22 and 24 which are typically vibratory feeders of well-known construction and operative to supply the respective components to respective feed tracks 26 and 28 by which the components are supplied in line one at a time to the rotating drum 10.

In the illustrated embodiment, three pairs of feeders are employed, each pair being arranged to serve an associated 120° sector of the drum. The throughput of assembled parts is enhanced by this multiple feed structure, but is not necessary for all embodiments.

Figure 2:
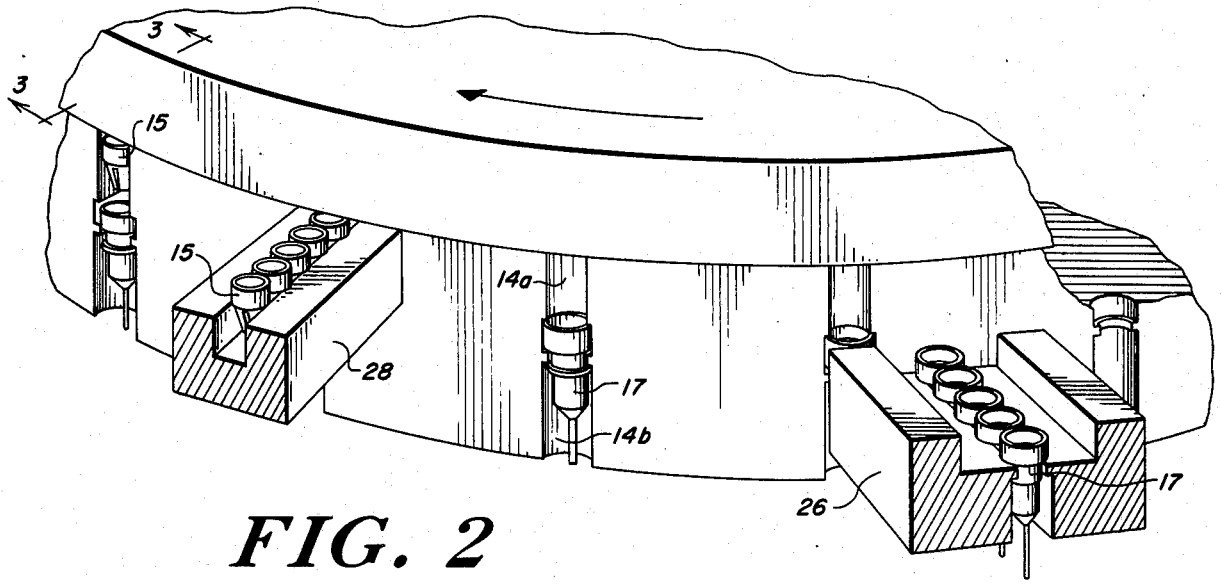

As seen more particularly in FIG. 2, the contact portions 15 of the sockets being assembled are retained single file in track 28, and are successively loaded into respective recesses **14*a* and retained in the recesses by vacuum. The sleeve portions 17 of the sockets are supplied in line by track 26 and are successively loaded into respective recesses 14*b* and retained therein by vacuum. The contact portions 15 are retained in the respective recesses 14*a* in aligned relationship a predetermined height above the sleeve portions 17 which are retained in respective recesses 14*b*. Preferably, the recesses 14*a* and 14*b*** are machined to conform to the shape of the corresponding parts.

In operation, the drum 10 continuously rotates at a predetermined angular velocity, and contacts and sleeves are fed from respective hoppers 22 and 24 to the respective recesses **14*a* and 14*b* where these components are retained by vacuum. As each recess 14*a* moves into alignment with the exit end of track 28, a contact 15 is urged from the track into the recess and retained therein by vacuum. In similar manner, as each recess 14*b* moves into alignment with the exit end of track 26, a sleeve 17 is urged from the track into the recess 14*b* and retained therein by vacuum. The drum 10, with the contacts and sleeves held in the respective recesses 14*a* and 14*b*, moves to a loading position generally designated by reference numeral 30, at which the contacts 15 are pressed by controlled camming action into the sleeve 17. The drum 10 next moves to an unloading position generally indicated by reference numeral 31, at which the assembled socket is ejected from its recess 14***b* into a hopper or other collecting vessel or means.

Figure 3:
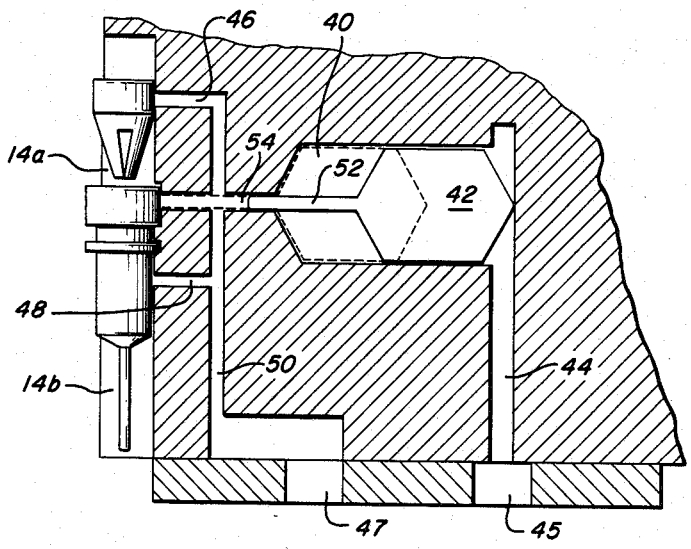

The drum mechanism for retaining the contact and sleeve portions in the respective recesses and for ejecting the assembled socket is shown in FIG. 3. The vacuum assembly includes for each aligned pair of recesses 14*a* and 14*b* a cylindrical chamber 40 having a cylindrical piston 42 movable therein, the chamber having an inlet coupled to a passage 44 which is coupled via a port 45 to a manifold, to be described. The piston 42 has an end of truncated conical configuration which is disposable in passage 44 when the piston is in its outward position. A pair of passages 46 and 48 communicate between the respective recesses 14*a* and 14*b* and passage 50 which is coupled to the manifold via a port 47, and by which vacuum pressure retains the respective contact and sleeve components. A pin 52 is connected to the piston and rides within an opening 54, the pin being drivable into the recess 14*b* for the purpose of ejecting or unloading the assembled socket from the rotating drum after assembly of the socket components. The manifold includes openings or ports providing positive pressure and vacuum pressure.

During application of vacuum pressure on the chamber, the piston 42 is drawn to its rearmost position as illustrated in solid outline in FIG. 3. Vacuum is also drawn through passages 46 and 48 for retention of the contact and sleeve portions in the respective recesses 14*a* and 14*b*. During application of positive pressure, the piston is driven to its forward position, illustrated in dotted outline in FIG. 3, which causes the pin 52 to be driven outward in passage 54 to eject the assembled socket from the recess 14*b*.

Figure 4:
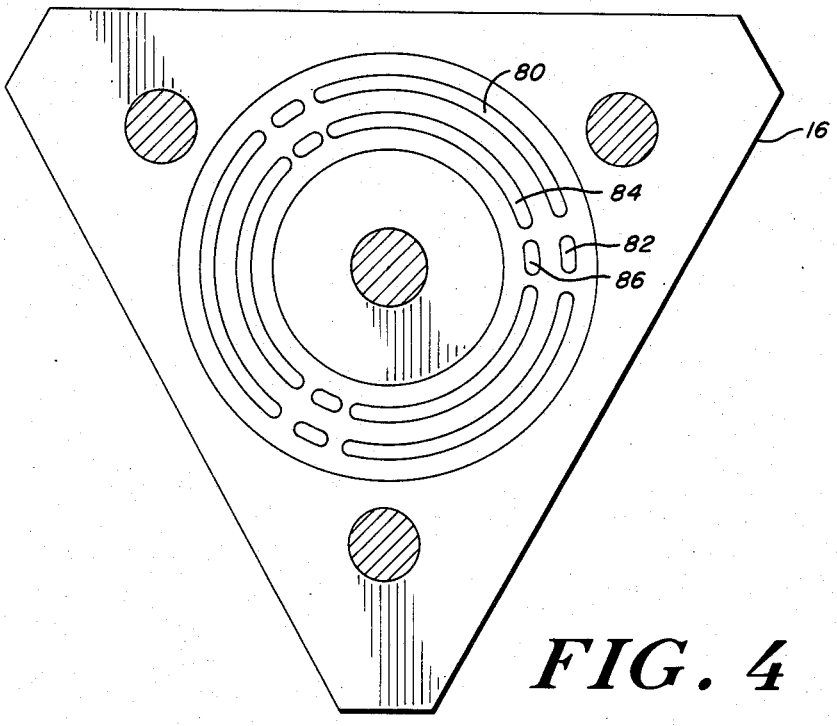

The manifold is illustrated in FIG. 4, and in this illustrated embodiment, is arranged for use with three assembly stations equally spaced about the periphery of the rotating drum. At each of the assembly stations, feed hoppers are provided for supplying the contacts and sleeves to the respective recesses of the rotating drum. The manifold includes an outer track having three elongated slots 80 and three intermediate shorter slots 82, and an inner track having three elongated slots 84 and three intermediate shorter slots 86. A vacuum is provided on the elongated slots 80 and 84, and positive pressure is provided on the slots 82 and 86. The slots 80 and 82 of the outer track are in fluid coupling arrangement with the port 45, while the slots 84 and 86 of the inner track are in fluid coupling arrangement with the port 47. Vacuum and positive pressure is provided to the manifold by a suitable source (not shown) which can be of any well-known construction. Fluid coupling between the rotating drum and the manifold is provided by any convenient rotatable fluid coupling which per se is known in the art.

When the ports 45 and 47 are in alignment with the elongated grooves 80 and 84, vacuum on port 47 aids in the transfer of the contact and sleeve from the feeders into the respective recesses, and retains the contact and sleeve in position within the respective recesses. Vacuum on port 45 causes the piston 42 to retract and remain in its inner position. When the ports are in communication with the slots 82 and 86, positive pressure on port 45 causes the piston to travel to its forward position, causing pin 52 to engage the assembled socket and eject the socket from its recess. Positive pressure on port 47 causes air pressure in passages 46 and 48 to aid in ejecting the assembled component from its recess.

In an alternative drum version, both vacuum and positive pressure can be sequentially provided to a common port. The manifold in this alternative version has a single track in alignment with the port, and vacuum is provided on elongated slots and positive pressure is provided on the intermediate slots. When the port is in alignment with the vacuum slots, vacuum causes retraction of the piston to its rearmost position and aids in transferring contacts and sleeves from the feeders to the associated recesses and for retention of these parts in the respective recesses. When the port is in alignment with the pressure slots, positive pressure causes propulsion of the piston to its forward position, thereby causing ejection of the assembled socket.

Figure 5:
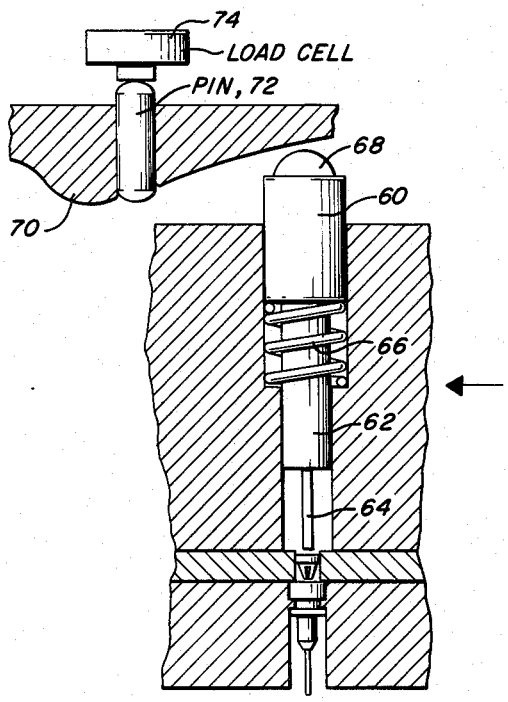
Figure 6:
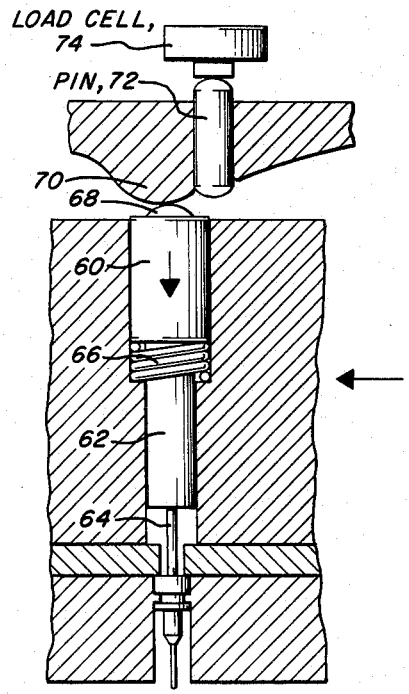

The drum includes a spring loaded plunger 60 in alignment with the recesses 14 as shown in FIGS. 5 and 6. Each plunger includes an upper portion slideable within an opening and attached to a shaft 62 slideable within a smaller opening. A pin 64 extends downwardly from the distal end of the shaft 62 and is disposed within an opening in the drum in alignment with the recess 14*a*. A spring 66 is provided within the larger opening and is operative to urge the plunger to a normally upward position as illustrated in FIG. 5. A cam follower 68 is disposed in a recess in the upper end of the player 60 for low friction contact with the camming surface of a cam 70 which is supported on the plate 18. A pin 72 is provided in the cam 70 to transmit the loading force to a load cell 74 for the purpose of measuring the actual force provided in seating the contact portion 15 into sleeve portion 17.

It will be appreciated that the novel assembly machine is also useful for the precision assembly of parts other than socket contacts. The invention is useful for the assembly of a part into a sleeve and especially for instances in which the inner part must be accurately retained within the sleeve. Various modifications and alternative implementations will occur to those versed in the art without departing from the spirit and true scope of the invention. Accordingly, it is not intended to limit the invention by what has been particularly shown and described, except as indicated in the appended claims.

What is claimed is:

1. Apparatus for the assembly of socket contacts comprising:

a cylindrical drum having a plurality of recesses disposed about the circumferential wall thereof, each of the recesses having a lower section adapted to retain the sleeve portion of a socket contact, and an upper section adapted to retain the contact assembly portion of the socket contact;

means for rotating the drum at a predetermined speed;

means for providing vacuum at each of the recesses for retention of the sleeve portion and contact assembly portion of the socket contacts in respective sections of the recesses;

means for supplying sleeve portions and contact assembly portions of the socket contacts to respective sections of the recesses;

means above the drum and operative during rotation of the drum to urge the contact assembly portions into the sleeve portions; and means for ejecting assembled socket contacts from the drum.

2. The apparatus of claim 1 wherein the supplying means includes:

means for conveying sleeve portions of the socket contacts to the drum for transfer to respective lower sections of the recesses as the drum rotates past a supply point; and means for conveying contact assembly portions of the socket contacts to the drum for transfer of the contact assembly portions to respective upper sections of the recesses as the drum rotates past the supply point.

3. The apparatus of claim 1 wherein the means above the drum includes:

means for monitoring the actual force applied during seating of the contact asembly portion into the sleeve portion; and camming means for urging the contact assembly portion into the sleeve portion.

4. The apparatus of claim 1 wherein said vacuum providing means includes:

means in fluid coupling relationship with the drum and providing vacuum and positive pressure to the drum.

5. The apparatus of claim 4 wherein the vacuum providing means includes:

a vacuum assembly within the drum, comprising for each of the recesses:

a chamber having a piston movable therein, the chamber having an inlet coupled via port means to the manifold;

the piston having a pin at the forward end thereof and rideable within an opening and operative to be driven into the recess for ejecting the assembled socket from the rotating drum after assembly of the socket components; and passages communicating between the respective sections of the recess and the port means to the manifold.

6. The apparatus of claim 4 wherein the manifold is contained in a base atop which the drum rotates.

7. The apparatus of claim 1 wherein the vacuum providing means includes a vacuum assembly within the drum for each of the recesses.

8. The apparatus of claim 7 including:

a manifold provided in a base atop which the drum is rotatable, the manifold including:

first and second concentric tracks along each of which is provided at least one port providing vacuum and at least one circumferentially spaced port providing positive pressure;

the ports of each track being in fluid coupling relationship with the rotatable drum for sequentially providing vacuum and positive pressure to the pneumatic assembly.

9. The apparatus of claim 4 wherein the vacuum assembly is operative in a first position to provide vacuum to the respective sections of the recess for retention of the socket components therein, and operative in a second position to provide positive pressure on the respective sections of the recess for ejection of an assembled socket contact from the recess.

10. The apparatus of claim 8 wherein the vacuum assembly for each of the recesses includes:

a chamber having a piston movable therein, the chamber having an inlet coupled to the manifold;

the piston being operative to be driven in the cylinder to a forward position and to a rearward position, the piston having a pin at the forward end thereof and movable within an opening in the drum communicating with the associated recess;

passages communicating between the respective sections of the recess and the manifold;

the piston being driven to a rearward position when the manifold provides vacuum to the assembly, and the passages providing vacuum to the recesses when the manifold provides vacuum to the assembly for retention of the socket components in the respective sections of the recess;

the piston being driven to a forward position when the manifold provides positive pressure to the assembly, and the passages providing positive pressure to the recesses when the manifold provides positive pressure to the assembly, thereby ejecting the assembled socket contacts from the recess.

11. Apparatus for the assembly of a first part into a sleeve comprising:

a cylindrical drum having a plurality of recesses disposed about the circumferential wall thereof, each of the recesses having a lower section adapted to retain the sleeve, and an upper section adapted to retain the first part;

means for providing vacuum and positive pressure at each of the recesses for retention of the first part and sleeve in respective sections of the recesses;

means for rotating the drum at a predetermined speed;

means for supplying sleeves and first parts to respective sections of the recesses as the drum rotates;

means above the drum and operative during rotation of the drum to urge the first part into the associated sleeve; and means for ejecting assembled sleeve and first parts from the drum.

12. Apparatus for the assembly of socket contacts comprising:

a base having a manifold therein for providing vacuum and positive pressure;

a cylindrical drum mounted for rotation on the base and having a plurality of recesses disposed about the circumferential wall thereof, each of the recesses having a lower section adapted to retain the sleeve portion of a socket contact and an upper section adapted to retain the contact assembly portion of the socket contact, and pneumatic means within the drum for coupling each of the recesses selectively to the manifold;

means for forming assembled socket contacts from said sleeve portion and said contact assembly portion;

means for rotating the drum at a predetermined speed; and means for supplying sleeve portions and contact assembly portions of socket contacts to respective sections of each recess as the drum rotates past a supply point;

the pneumatic means being operative to provide vacuum at the recesses for retention of the sleeve portions and contact assembly portions of the socket contacts after they are supplied to the recesses, and operative to provide positive pressure at the recesses to eject assembled socket contacts.

* * * * *

UNITED STATES PATENT AND TRADEMARK OFFICE

CERTIFICATE OF CORRECTION

PATENT NO. : 4,616,410

DATED : October 14, 1986

INVENTOR(S) : Philip T. Stokoe, et al

It is certified that error appears in the above-identified patent and that said Letters Patent is hereby corrected as shown below:

Column 1, line 56, "circumferential" should read --cylindrical--.

Column 5, line 13, "asembly" should read --assembly--.

Signed and Sealed this

Second Day of February, 1988

*Attest:*

DONALD J. QUIGG

*Attesting Officer*

*Commissioner of Patents and Trademarks*